United States Patent [19]

Disch et al.

[11] 4,105,398

[45] Aug. 8, 1978

[54] CONTINUOUS PRODUCTION FURNACE TO HEAT RING-SHAPED WORKPIECES

[75] Inventors: Günther Disch, Gerlingen; Elmar Noormets, Boblingen, both of Fed. Rep. of Germany

[73] Assignee: J. Aichelin KG, Stuttgart, Fed. Rep. of Germany

[21] Appl. No.: 739,644

[22] Filed: Nov. 8, 1976

[30] Foreign Application Priority Data

Nov. 8, 1975 [DE] Fed. Rep. of Germany ..... 2550325

[51] Int. Cl.[2] ..... F27B 9/00

[52] U.S. Cl. ..... 432/121; 198/442; 198/453; 198/454; 198/462; 432/124; 432/239; 432/246

[58] Field of Search ..... 432/121, 124, 239, 246; 198/442, 452, 453, 454, 461, 462

[56] References Cited

U.S. PATENT DOCUMENTS 3,338,569 8/1967 Cuvelier ..... 432/246

3,866,739 2/1975 Sikorski ..... 198/453

FOREIGN PATENT DOCUMENTS 736,793 6/1966 Canada ..... 198/453

*Primary Examiner*—John J. Camby

*Attorney, Agent, or Firm*—Flynn & Frishauf

[57] ABSTRACT

To permit random loading of workpieces for passage through a furnace, and removal of the workpieces for subsequent handling by presses and the like, the furnace is constructed as a roller hearth furnace in which the width of the roller hearth is a multiple of the diameter of the ring-shaped workpieces, and adjacent the outlet an aligning means is provided in the form of a funnel of which one side wall is movable, for example by longitudinal or transverse reciprocation to align the randomly positioned workpieces in single file. A roller conveyor, with progressively increasing conveyor speed, is located beneath the aligning funnel to remove the aligned workpieces in single file for subsequent handling and treatment.

12 Claims, 2 Drawing Figures

CONTINUOUS PRODUCTION FURNACE TO HEAT RING-SHAPED WORKPIECES

Figure 1:
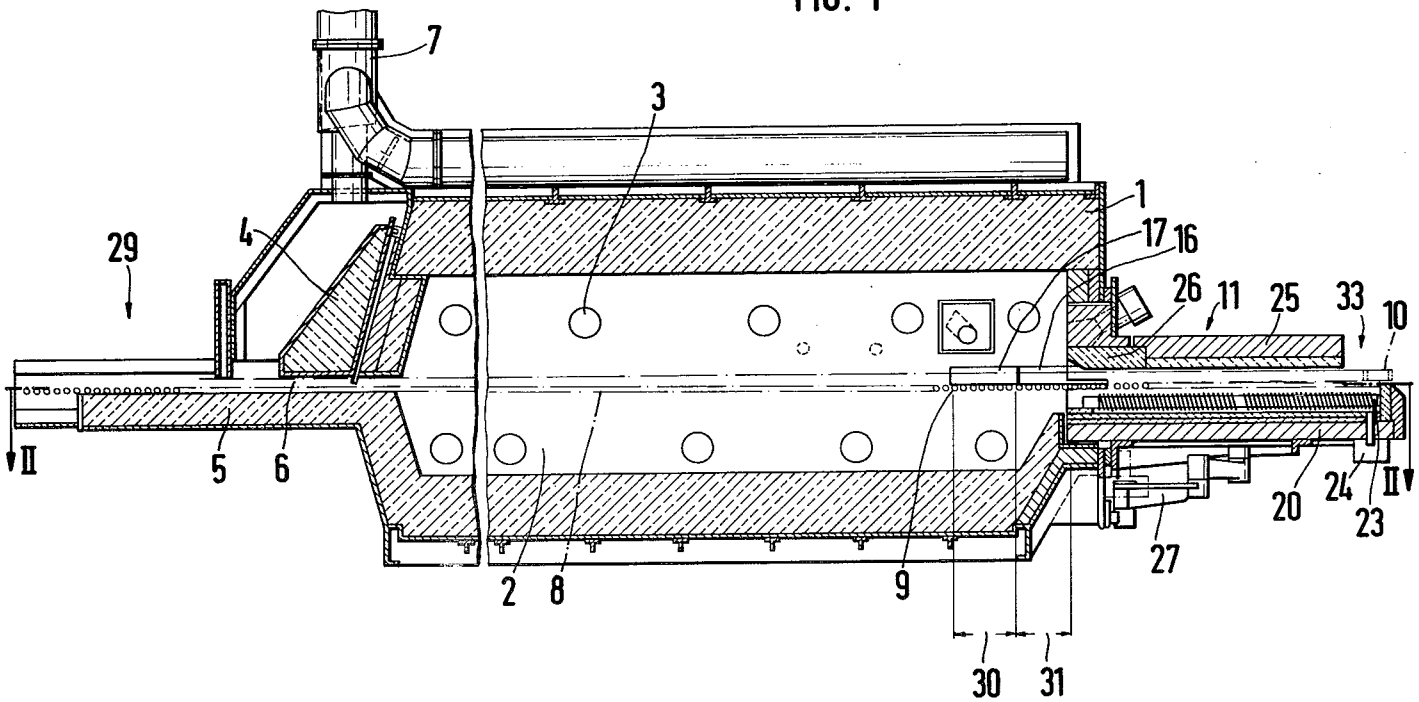

The present invention relates to furnaces, and more particularly to furnaces to pre-heat or heat workpieces in continuous production processes, and then to supply the heated workpieces — now difficult to handle — to further treatment stations.

High-precision, ring-shaped workpieces, such as bearing rings for roller bearings, can be tempered or hardened only in special tempering presses or tempering apparatus. Such tempering presses or apparatus require that the heated workpieces are applied thereto as single elements.

It has previously been proposed to uniformly heat ring-shaped metal portions in continuous processes in which the workpieces are singly introduced — see, for example, German Published Patent Application DT-AS 2,010,433. Such an apparatus can be used only in very large production series and for such ring-shaped workpieces which have a suitable support surface so that they can be reliably stacked above each other.

It has also been proposed to heat ring-shaped workpieces by using strip-shaped furnaces with a transport conveyor on which the ring-shaped workpieces are placed in sequentially aligned positions. The workpieces must be placed with substantial distance from each other resulting in poor space utilization of the furnace itself, low production rates with respect to the size of the furnace, and excessive space and heat requirements. The rings, further, must be transported from the transport conveyor to the hardening presses or apparatus with comparatively complex, and hence expensive conveyor systems.

It is an object of the present invention to provide a furnace which can continuously operate and continuously heat ring-shaped workpieces in a continuous production process in which the furnace space is completely utilized, placement of the workpieces and transport thereof into the furnace do not result in problems, while removal of the workpieces from the furnace results in a train of aligned workpieces being removed, one-by-one, for further transport, for example, to a hardening press or apparatus.

SUBJECT MATTER OF THE PRESENT INVENTION

Briefly, the furnace is constructed as a roller hearth furnace in which the roller hearth has a width which is a multiple of the diameter of the ring-shaped workpieces, so that a plurality of workpieces can be placed thereon in adjacent random positions. Adjacent the exit opening of the furnace, a generally funnel-shaped or converging guide means is provided of which, preferably, at least one side wall is movable in oscillatory or reciprocating manner transversely or longitudinally with respect to the removal path of the workpieces from the furnace, so that the workpieces are guided in a converging path towards the exit in single, aligned position. Preferably, a roller conveyor is associated with the converging guiding portion which has progressively increasing removal speed, for example in steps, so that workpieces are removed from sections of the converging zone more rapidly than from zones of greater width.

A plurality of randomly located workpieces can thus be introduced into the furnace; the workpieces, after having been heated in the furnace, are then removed in single line for transport to a removal station.

Since the ring-shaped workpieces are located on the much wider roller hearth during their passage through the furnace, it is possible to substantially increase the through-put of workpieces per hour, that is, the treatment rate. The workpieces can be introduced into the furnace by hand, or automatically by any suitable well-known and simple conveyor or transport arrangement. The position of the workpieces with respect to each other while on the roller hearth is irrelevant, and thus the charging of the furnace can be carried out by any transport device without consideration of particular placement of the workpieces themselves.

Figure 2:
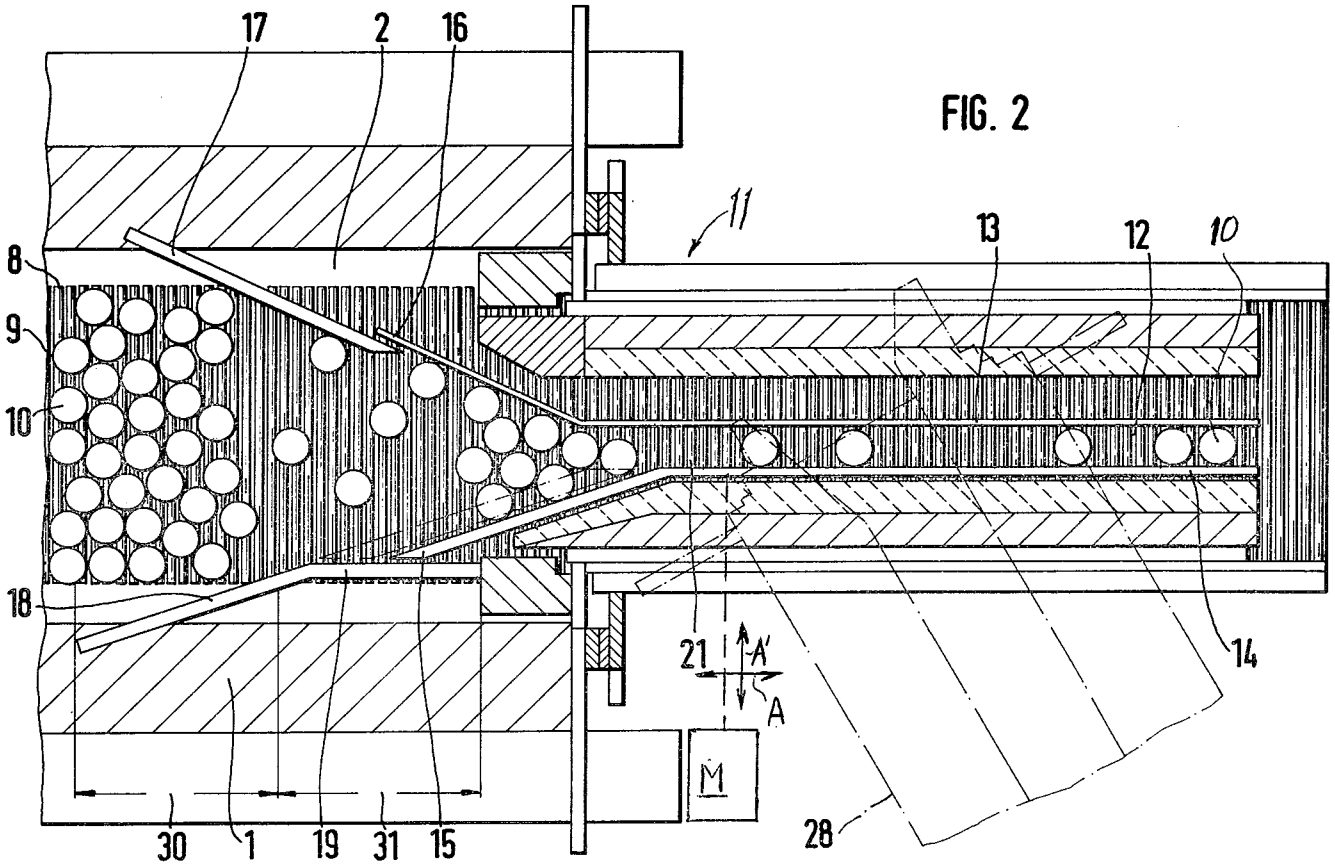

The invention will be described by way of example with reference to the accompanying drawings, wherein:

FIG. 1 is a highly schematic longitudinal axial section of the furnace and the transport arrangement; and FIG. 2 is a top view, sectioned along line II—II of FIG. 1, of a portion of the furnace, omitting the entrance part, and drawn to an enlarged scale.

The furnace is a roller hearth furnace having a housing 1 (FIG. 1) which is made of a heat-insulating material and defines therein a furnace chamber 2 which can be heated by jet heaters, as schematically shown at 3. The furnace chamber 2 has an entrance section which is closed off by a door 5 except for a narrow gap 6 which is in communication with a horizontal supply table 5 for introduction of workpieces 10. The combustion gases are removed by a flue duct 7.

A roller hearth 8 extends throughout the chamber 2 to form a transport or conveyor arrangement for the workpieces 10. The roller hearth 8 is formed of parallel driven, adjacently positioned rollers 9. Only a portion of the rollers 9 is shown in FIG. 1. The rollers extend over the inlet table 5. The width of the roller hearth 8, as best seen in FIG. 2, is several times the diameter of the workpieces 10.

The outlet end of the furnace chamber 2 includes an arrangement to remove the workpieces in such a manner that they will appear in single file. This arrangement 11 receives the hot ring-shaped workpieces 10, supplied from the roller hearth 8, in the random position in which they are passed through the furnace and separates the workpieces so that they can be supplied, at the terminal end of the arrangement 11, to a removal station 33 from where they can be removed by further apparatus, not shown, for example for placement into a hardening press or hardening apparatus.

The separating and aligning arrangement 11 is formed with an exit duct 12 which defines the exit path of the workpieces 10. One side of the duct 12 is defined by a fixed side wall 13; this side wall may, for example, be a strip of suitable heat-resistant material. The other side wall defining the ducts 12 is a strip 14 which is movable under control of a reciprocating drive M, in longitudinal direction, with respect to the path of the workpieces 12, as indicated schematically by arrow A, and transversely thereto, as indicated schemtically by arrow A'. The minimum width of the exit path 12 is so matched to the diameter of the workpieces 10 that only one workpiece 10 can travel down the duct at a time, so that the workpieces will be longitudinally aligned, as seen in FIG. 2. The movable side or strip 14 expands funnel-shaped towards the inner side of the roller hearth 8, as seen in FIG. 2, and is formed into an outwardly diverging strip 15. The opposite side of the duct is defined by a strip 16 which likewise diverges with respect to the direction of the roller hearth 8. The strips 15, 16 both extend above the terminal rollers of the roller hearth 8. Additional guide strips 17, 18 are located interiorly of the furnace chamber 8. Strip 17 is offset with respect to strip 16 and overlaps strip 16 at the adjacent terminal end. Strip 18 has a portion 19 which extends parallel to the path taken by the workpieces when separated and aligned so that the diverging end 15 of stip 14 may reciprocate back and forth with respect thereto, as indicated, respectively, by the solid-line and chain-dotted line positions in FIG. 2. Strips 17, 18 likewise are located above the rollers of the roller hearth 8. The strips 16 to 19 together with strip 15 of the movable strip 14 form a funnel-shaped outlet guide for the duct 12.

The strips 13, 14 are located above an exit table 20 (FIG. 1) on which a further conveyor arrangement 21 (FIG. 2) is arranged, joining the rollers of the roller hearth 8. The rollers of the conveyor 21 are parallel to those of the roller hearth and are placed beneath the open outlet duct 12 such that they will continue to transport the workpieces 10 and remove them from the furnace.

The reciprocating drive M, shown in FIG. 2 only schematically, is a drive arrangement or gear 24 engaging an eccenter pin 23 which moves strip 14 back-and-forth (FIG. 1); other arrangements may be used. In the embodiment shown in FIG. 1, strip 14 and hence the divergent funnel-shaped portion 15, moves only parallel to the path taken by the workpieces 10 when in the duct 12. It is also possible to reciprocate strip 14, and hence strip 15 only in a direction transverse to said path, rather than in both directions as shown by arrows A, A'. The limiting positions for longitudinal — with respect to the path taken by the workpieces — reciprocating motion is indicated by the solid-line and chain-dotted line positions of strip 15 in FIG. 2.

As cover 25 (FIG. 1) is located above the strips 13, 14, with some clearance; cover 25, together with the closure 26 for the furnace chamber, is secured to the exit or outlet table 20 and covers the duct 12. The closure element 26 closes the outlet of the furnace chamber 2.

The separating arrangement 11 is pivotally secured to the housing 1 of the furnace so that it can be swung away, while maintained in location, to permit access to the furnace chamber 2 for servicing, cleaning, or the like. A pivot or link holder 27, having vertical, parallel pivoting axes, permits swinging the entire arrangement 11 away from the chamber 2, as indicated by the chain-dotted lines 28 in FIG. 2. This permits easy access to the furnace chamber 2 from the exit side of the furnace.

OPERATION

The ring-shaped workpieces are placed on the conveyor rollers at position 29 (FIG. 1), where the rollers have a width corresponding approximately to the width of the furnace, that is, preferably the width of the roller hearth 8. They are placed at random adjacent each other, as seen for example in zone 30 (FIG. 2). The rollers 9 of the roller hearth transport the workpieces 10 through the slit 6 into the furnace chamber 2 where the workpieces 10 are heated to the desired temperature. The circumferential speed of the rollers 9 of the roller hearth increases with respect to rollers positioned upstream to facilitate removal of the workpieces as separate elements. Thus, the speed of the rollers in the zone 30 is higher than that of the rollers to the left thereof (with respect to the drawings), and the speed of the rollers in the zone 31 is higher than the speed of the rollers in the zone 30. The rollers in the zones 30, 31 can all be driven together, so that the differential speeds of the rollers are arranged in zones.

The heated workpieces are transported by the roller 9 of the roller hearth 8 in the region of the strips 17, 18 (FIG. 2) whereupon they reach, sequentially, the zones 30, 31. Since the circumferential speeds of the rollers 9 in these regions increases, in steps, workpieces 10 are transported in the transport direction with increasing distance from each other; they are drawn apart, as schematically indicated in FIG. 2. The now more widely separated workpieces 10 are guided or squeezed by the inclined strips 17, 18 and 15, 16 towards the entrance of the duct 12 so that they will be positioned along the longitudinal axis of duct 12, that is, towards its central path, to be removed through the duct 12 in longitudinally aligned, staggered placement by the conveyor rollers 21. The conveyor rollers 21 then transport the longitudinally aligned workpieces 10 to the removal station 33 for further removal, for example transversely to the transport direction of duct 12 by a pusher or ejection element (not shown) and for introduction, for example, to a hardening press or for further treatment or machining.

The movable strip 14 reciprocates back-and-forth under control of the arrangement 23, 24 or, as schematically shown in FIG. 2, in accordance with arrow A. Movement of the strip 14 and its extension 15 prevents jamming of workpieces 10 even though they are squeezed into a single path by the inclined sections 15 and 16.

Various changes and modifications may be made. Thus, the strip 14 can reciprocate as shown by arrow A, reciprocate transversely as shown by arrow A', or move in accordance with both arrows, as desired; the strips 16, 17 may, likewise, be made movable, and driven similarly to strip 14. Movement can be in form of oscillating movement or in form of vibration in longitudinal direction, transverse direction, or both. The type of drive to generate the required movement is well known.

The strip 15 can be separated from strip 14; the direction and type of movement can be suitably selected to match the shape and size of the workpieces.

At least two sections or zones of different speed ranges with respect to the transport speed through the furnace are preferred. The progressive increase in the speed of transport of the ring-shaped workpieces as they approach the exit opening, due to the progressive increase in speed of the rollers of the roller hearth, results in reliable separation of the workpieces with respect to each other and thus introduction, in single file, into the duct 12 in spite of the converging space available for the workpieces, as defined by the strips 15–19.

We claim:

1. Continuous production roller hearth furnace to heat circular workpieces (10) having a furnace housing (1) defining a roller hearth furnace chamber (2) and having an inlet opening and an outlet opening, input driven transport means extending from outside of the housing (1) through the inlet opening into the furnace chamber, a roller hearth (8) which has a width which is a multiple of the diameter of the circular workpieces to receive a plurality of said workpieces (10) thereon randomly, adjacently positioned;

outlet transport means extending outside of the furnace chamber from the outlet opening to remove heated workpieces therefrom;

and means (11) located adjacent the outlet opening to automatically orient the workpieces in single file for removal of the heated workpieces (10) from the furnace chamber in said single file by the outlet driven transport means and for transport to a receiving station (33), comprising limit means (15–19) defining an outlet path (12) having an inlet width matched to the width of the roller hearth (8) and extending in a direction of transport of the workpieces (10) through the furnace and narrowing, funnel-shaped, to a width approximately matched to the width of the workpieces (10), said limit means including at least one side wall (14) formed with an outwardly diverging portion (15) at the region thereof directed toward said chamber (14), located laterally with respect to said path and being cyclically movable with respect to said path (12) in a direction essentially parallel to said path (12);

means (M) coupled to said side wall (14) moving said side wall in said direction essentially parallel to said path;

and driven conveyor means (21) beneath the path to move the workpieces (10) from the chamber (2) outside thereof in single file along said path.

2. Furnace according to claim 1, wherein said movable side wall (14) is additionally cyclically movable in a direction essentially transverse to said path (12);

and said moving means (M) impart said additional movement to said side wall.

3. Furnace according to claim 1, wherein said moving means comprises vibrating means imparting vibratory movement to said movable side wall (14).

4. Furnace according to claim 1, wherein said limit-defining means comprises a fixed side wall (16, 17), located opposite said movable side wall and having a portion (16, 17) which diverges with respect to said path (12), said diverging portion being located within said chamber (2);

and wherein said limit means are located above the rollers (9) of the roller hearth (8).

5. Furnace according to claim 1, wherein the limit means (15–19) comprises a plurality of side wall elements (15, 16, 17, 18) located in cascade, staggered relationship within said furnace chamber (2) and positioned above the rollers (9) of the roller hearth.

6. Furnace according to claim 1, further including a fixed side wall portion (18) located inwardly within the chamber (2) with respect to said movable side wall (14, 15), the movable side wall fitting against said fixed side wall portion (18).

7. Furnace according to claim 1, wherein the outlet rotating transport means includes rollers driven with progressively increasing speed in the direction towards the outlet from the furnace chamber.

8. Furnace according to claim 7, wherein the rollers (9) are divided into groups (30, 31), the rollers of any one group rotating at the same speed, the groups of rollers rotating with different and increasing speeds in the direction towards the outlet of the chamber (2).

9. Furnace according to claim 8, wherein at least two groups of rollers rotating at progressively increasing speeds are provided, the speed of the first group being higher than the speed of the rollers of the roller hearth.

10. Furnace according to claim 1, wherein the driven conveyor means (21) comprises a roller conveyor adjoining the rollers (9) of the roller hearth.

11. Furnace according to claim 1, wherein said means (11) aligning the workpieces in single file form a separate assembly removably secured to the furnace housing (1).

12. Furnace according to claim 11, wherein said separate assembly is pivotally attached to the furnace housing to permit swinging of said assembly away from the outlet of the furnace chamber to provide for access to the furnace chamber unimpeded by said single file aligning means.

* * * * *